United States Patent [19]

McInnes

[11] Patent Number: 4,493,310

[45] Date of Patent: Jan. 15, 1985

[54] HEAT EXCHANGER

[75] Inventor: Malcolm B. McInnes, Burwood East, Australia

[73] Assignee: Pyrox Limited, Moorabbin, Australia

[21] Appl. No.: 509,207

[22] Filed: Jun. 29, 1983

[30] Foreign Application Priority Data

Jul. 1, 1982 [AU] Australia ..... PF4665

[51] Int. Cl.[3] ..... F24C 3/04

[52] U.S. Cl. ..... 126/92 C; 126/108; 126/307 R

[58] Field of Search ..... 126/307 R, 307 A, 108, 126/299 F, 300, 91 C, 92 C, 116 R; 165/112, 113

[56] References Cited

U.S. PATENT DOCUMENTS 2,290,255 7/1942 Smith ..... 126/108
4,141,410 2/1979 Takada ..... 165/113

FOREIGN PATENT DOCUMENTS 1536339 12/1978 United Kingdom ..... 126/92 C
2096307 10/1982 United Kingdom ..... 126/92 C

*Primary Examiner*—Samuel Scott
*Assistant Examiner*—G. Anderson
*Attorney, Agent, or Firm*—Abelman, Frayne, Rezac & Schwab

[57] ABSTRACT

A heat exchanger for use with a source of heat in the form of a burner arrangement. The heat exchanger includes a relatively high flow resistance main passage for collecting combustion products from directly above the burner and a low flow resistance secondary passage opening forwardly of the main passage inlet and conveying any combustion products not collected by the main passage relatively directly to the flue. Flue downdraft principally affects flow in the secondary passage. The main passage may include a plurality of chambers to increase the heat exchange surface area. Water condensing in the main passage can be collected and drained to an evaporator rear the burner.

10 Claims, 10 Drawing Figures

HEAT EXCHANGER

Figure 1:
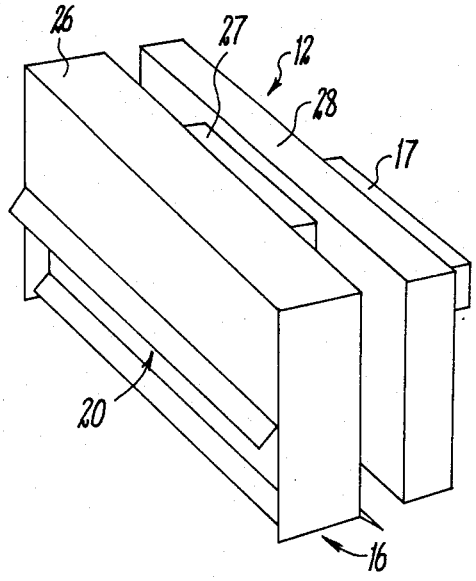

This invention relates to a heat exchanger for use in heating apparatus having a source of heat, such as a burner arrangement and a flue for discharge of combustion products, the heat exchanger being associated with the heat source so that the heat is transferred to a working fluid passing through the heat exchanger. The invention also relates to a heating apparatus including such a heat exchanger.

The present invention has been particularly developed for a gas space heater in which air to be heated is blown through the heat exchanger but the invention is not limited to this particular application. It will be convenient, however, to hereinafter describe the invention with reference to gas space heaters. A problem with gas space heaters is that the efficiency can be influenced, especially in open fronted flued radiant gas space heaters, by the installation environment or more specifically the flue draw. Under Australian Gas Association regulations, all space heaters must pass all combustion and spillage tests, (the amount of by-products from combustion which can enter the room being heated) on a flue with little or no draw, i.e. 0.6 meter flue. However when the tested unit is installed in the field a flue which extends at least 4.5 meters upwards from the base of the appliance must be used to comply with gas fitting regulations. The result is that a unit which has the optimum back pressure etc. on the laboratory test flue for maximum efficiency without spillage usually operates below this level of efficiency when installed because the designed back pressure is not sufficient to stop the increased flue draw pulling extra cold air from the room being heated into the heat exchanger. The authorities will not change their regulations on the test flue length because of the underlying assumption that a poorly maintained flue of the minimum installation length could have a flue draw pattern similar to the test flue.

It is an object of the present invention to provide a heat exchanger in which the flue draw has less adverse effect on efficiency of the heat exchanger.

According to the present invention there is provided a heat exchanger for use in a heating apparatus having a source of heat in the form of a burner arrangement and a flue for discharging combustion products from the heating apparatus, the heat exchanger being arranged to be associated with the heat source so that heat is transferred from the heat source to a working fluid which in use is in heat exchange relationship with the heat exchanger, said heat exchanger including a main passage arranged to collect from the burner arrangement hot combustion products and to convey those products through a main portion of the heat exchanger in heat exchange relationship with the working fluid and thence to the flue of the heating apparatus, a secondary passage arranged to collect combustion products not collected by the main passage and to convey those products to the flue, the secondary passage having a lower resistance to flow of combustion products therethrough than the main passage. The provision of two flow passages with a greater flow resistance through the main passage results in changes in flue draw mainly affecting the secondary passage.

Preferably the main passage has an inlet opening adapted to be located in proximity to the burner arrangement so as to collect substantially all the hot combustion products therefrom. Usually it is expected that the inlet opening of the main passage would, in use, be located substantially directly above the burner arrangement. Preferably the secondary passage has an inlet opening located adjacent to the main passage inlet opening so as to collect in normal operation of the heating apparatus substantially all combustion products not collected and passed through the main passage.

The differential flow resistance of the two passages may be achieved by a construction in which the secondary passage provides a relatively direct flow path for combustion products passing therethrough to the flue, the main passage providing an indirect path through the heat exchanger to the flue. For example, the main passage may provide a relatively tortuous path for flow of combustion products. Also, the main passage may be arranged to discharge combustion products laterally into the secondary passage or into the flue so that any flue downdraft will tend to affect combustion product flow in the secondary passage rather than in the main passage.

In one possible construction of the heat exchanger, the secondary passage has an intake portion which extends upwardly and a transfer portion which extends rearwardly to communicate with the flue. The main passage includes an inlet duct which extends upwardly around the secondary passage and to a front chamber located above the secondary passage, the main passage further including a rearwardly extending transfer duct extending from the front chamber to a rear chamber portion, the rear chamber portion being in communication with either the secondary passage or the flue for discharge of combustion products passing through the main passage, the outside surface areas of the main passage providing at least a major portion of the heat exchanger surfaces over which the working fluid is arranged to pass. To maximise the heat exchanger efficiency the rear chamber portion preferably comprises a plurality of chambers arranged to receive combustion products from the front chamber and the transfer duct, the rear chambers being spaced apart so that the working fluid can pass between the chambers, the outside surfaces of the chambers providing a large effective heat exchanger surface area. In this construction, the heat exchanger may include a passage divider for separating the flow of combustion products through the main and secondary passages, the passage divider being located within the transfer portion of the secondary passage so as to divide the secondary passage into a secondary flow path and an outlet portion for the main passage, the plurality of rear chambers of the main passage being operable to discharge combustion products into the outlet portion and the flow of combustion products through the outlet portion joining with the flow of combustion products from the secondary flow path adjacent the flue.

In embodiments where the main passage has an inlet opening in close proximity to the burner arrangement there may be provided a draft deflector operable to deflect any reverse flow through the main passage under flue downdraft conditions away from the associated burner arrangement.

Because the efficiency of the heat exchanger can be high, water condensation is likely and therefore it is preferred to provide condensate collecting means arranged to collect and drain any water condensing within the main passage. The condensate collecting means may include a collecting channel arranged to pass the condensate to an evaporator of porous heat resisting material located adjacent the burner arrangement where the condensate will be evaporated by the heat from the burner arrangement.

Figure 2:
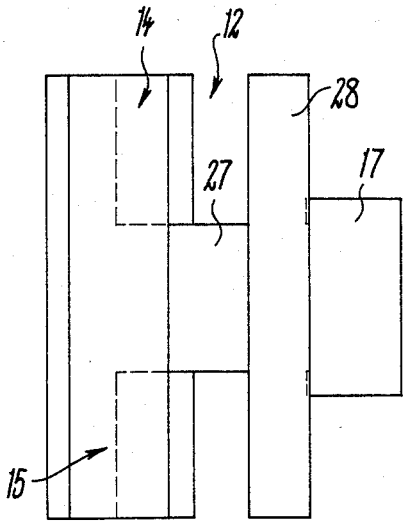
Figure 3:
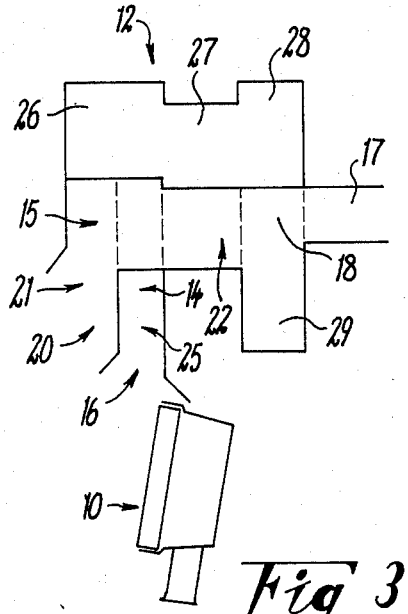
Figure 4:
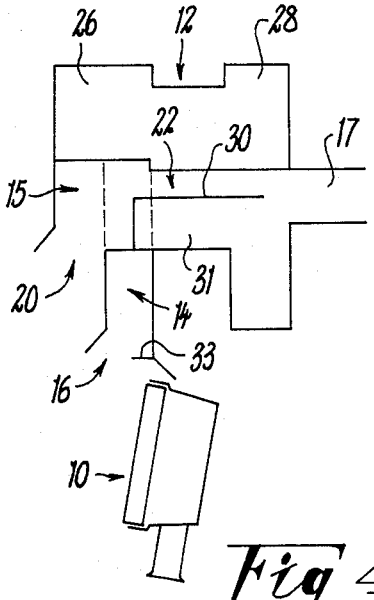
Figure 5:
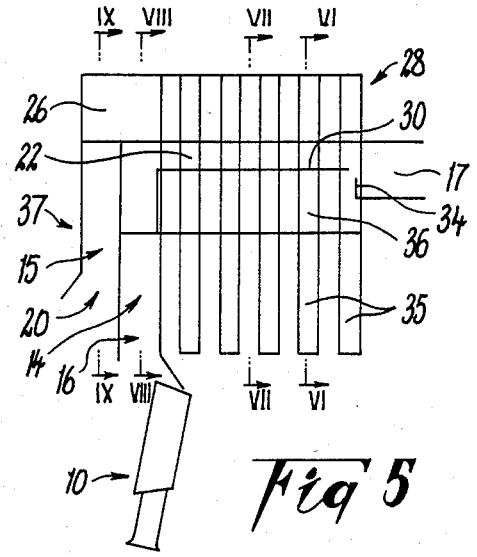
Figure 6:
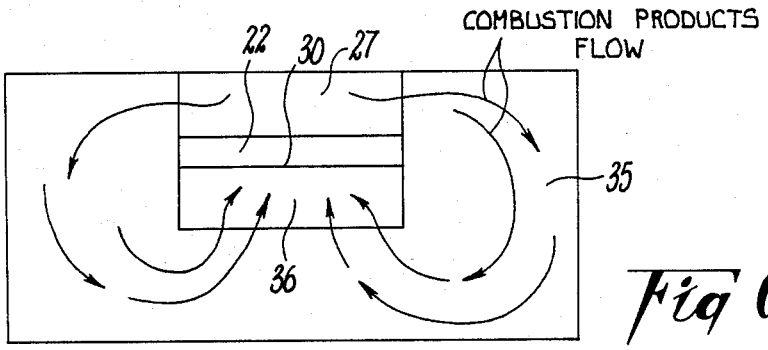
Figure 7:
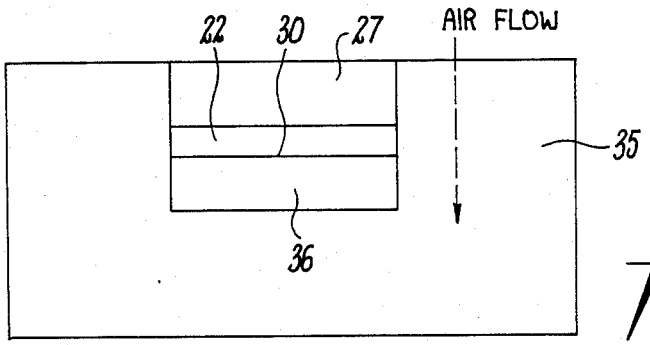
Figure 8:
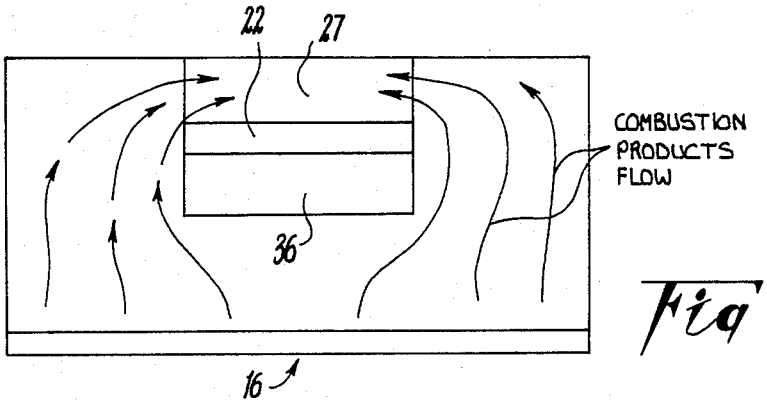
Figure 9:
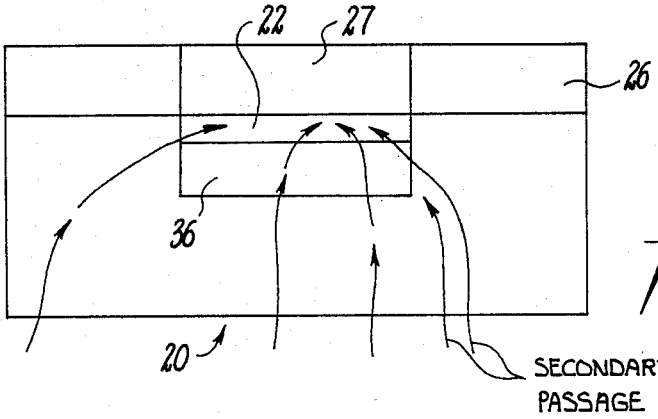
Figure 10:
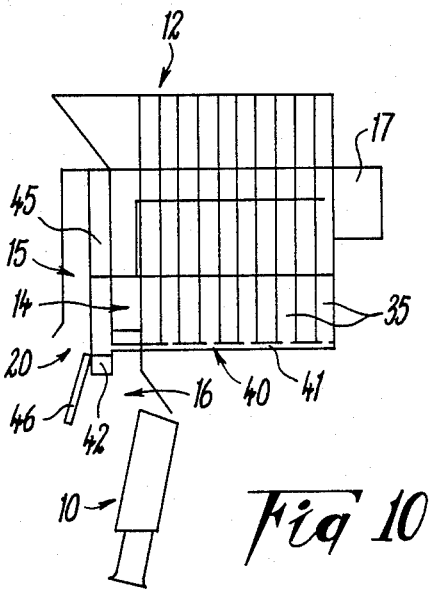

Several possible embodiments of the present invention will now be described with particular reference to the accompanying drawings, in which:

FIG. 1 is a perspective view of a first embodiment of a heat exchanger according to the present invention, FIG. 2 is a top plan view of the heat exchanger shown in FIG. 1, FIG. 3 is a side sectional view of the heat exchanger of FIG. 1, FIG. 4 is a side sectional view of a second embodiment of a heat exchanger according to the present invention, FIG. 5 is a side sectional view of a third embodiment having a plurality of rear chambers, FIG. 6 is a cross sectional view of the FIG. 5 embodiment taken along the line VI—VI of FIG. 5, FIG. 7 is a cross sectional view taken along the line VII—VII of FIG. 5, FIG. 8 is a cross sectional view taken along the line VIII—VIII of FIG. 5, FIG. 9 is a cross sectional view taken along the line IX—IX of FIG. 5, FIG. 10 is a side elevational view of a fourth embodiment of the present invention.

Referring now to FIGS. 1 to 3 the first embodiment of the heat exchanger according to the present invention is for use in a heating apparatus having a source of heat in the form of a burner arrangement such as a gas burner 10 and a flue (not shown) for discharging combustion products from the heating apparatus. The heat exchanger 12 is arranged to be associated with the heat source 10 so that heat is transferred from the heat source 10 to a working fluid comprised by circulating air which in use is in heat exchange relationship with the heat exchanger 12. The heat exchanger 12 includes a main passage 14 arranged to collect from the burner arrangement 10 hot combustion products and to convey those products through a main portion of the heat exchanger 12 in heat exchange relationship with air and thence to the flue of the heating apparatus. The heat exchanger 12 also includes a secondary passage 15 arranged to collect combustion products not collected by the main passage 14 and to convey those products to the flue, the secondary passage 15 having a lower resistance to flow of combustion products therethrough than the main passage 14.

The main passage 14 has an inlet opening 16 adapted to be located in proximity to the burner arrangement so as to collect substantially all the hot combustion products therefrom. The inlet opening 16 is provided with an outwardly flared mouth for collecting the combustion products. The heat exchanger 12 is arranged so that the main passsage 14 collects the combustion products from substantially directly above the associated burner arrangement 10 so that the hot combustion products rising by convection from the burner 10 directly enter the main passage inlet 16. The main passage 16 provides a relatively indirect path for combustion products through the heat exchanger 12 to the flue connected to the outlet 17 and this will be described later in the specification. The main passage 14 discharges combustion products to the outlet 17 through a venturi arrangement 18 in which the main passage 14 opens into a side of the outlet 17 where that outlet 17 is relatively constricted.

The secondary passage 15 is operable to collect substantially all combustion products not collected by the main passage 14. However, in the preferred embodiment described later, when there is a flue downdraft the secondary passage 15 may not collect the excess combustion products. The secondary passage 15 has an inlet opening 20 located to collect combustion products from adjacent the main passage inlet 16. For example, in the illustrated case where the heat exchanger 12 is associated with a gas burner 10 having a radiant element arranged to face outwardly into a room to be heated, the heat exchanger 12 is located with its main passage inlet 16 substantially directly above the radiant element and the secondary passage inlet 20 is located forwardly of the main passage inlet 16. As with the main passage inlet 16, the secondary passage inlet 20 is provided with an outwardly flared mouth to facilitate collection of combustion products.

The secondary passage 15 has a lower resistance to flow than the main passage 14 and to achieve this feature the secondary passage 15 provides a relatively direct flow path to the flue. The main passage 14 provides a relatively tortuous path for flow of combustion products and the main passage 14 is arranged to discharge combustion products laterally into the secondary passage 15, outlet 17 or into the flue so that any flue downdraft will tend to affect combustion product flow in the secondary passage 15 rather than in the main passage 14.

The secondary passage 15 has an intake portion 21 which extends upwardly and a transfer portion 22 which extends rearwardly to communicate through outlet 17 with the flue. The main passage 14 includes an inlet duct 25 which extends upwardly around the secondary passage 15 and to a front chamber 26 located above the secondary passage 15, the main passage 14 further including a rearwardly extending transfer duct 27 extending from the front chamber 26 to a rear chamber portion 28. The rear chamber portion 28 is in communication with either the secondary passage 15 or the outlet 17 for discharge of combustion products passing through the main passage 14. The outside surface areas of the main passage 14 provide at least a major portion of the heat exchanger surfaces over which the working fluid is arranged to pass. As mentioned above, the fluid to be heated in the case of a space heater is air which is blown or drawn over the outer surfaces of the main passage 14 and optionally part of the secondary passage 15.

The combustion products in the main passage 14 pass upwardly in the inlet duct 25 to the front chamber 26 and then pass from the front chamber 26 through the relatively short rearwardly extending transfer duct 27 to the rear chamber portion 28, the combustion products passing downwardly through an outlet portion 29 so as to enter into the secondary passage 14 or outlet 17 from beneath. In a possible modification not shown in the drawings, the combustion products passing through the main passage 14 may discharge laterally into the upper portion of the secondary passage 15 or outlet 17 from rear chamber portion 28, i.e. the lower outlet portion 29 is not provided.

In use of the heat exchanger of FIGS. 1 to 3, under normal operating conditions, the combustion products from the burner 10 will rise directly into inlet 16 and pass through the main passage 14 through the outlet 17 to the flue. Air is blown or drawn over a substantial portion of the outside surface area of the heat exchanger and is passed into the room being heated. Under initial starting conditions the temperature of the burner products will be lower than under normal operating conditions and so the convective updraft may not carry all the combustion products into the main passage inlet 16. Some combustion products may pass around the front of the inlet 16 and enter the secondary passage inlet 20 and such products will pass through the secondary passage 15 to the flue.

If a flue downdraft occurs the draft will tend to pass from the outlet 17 directly into the secondary passage transfer portion 22 and forwardly out of inlet 20, i.e. away from burner 10. Little effect on hot combustion products flow through main passage 4 will occur although the products discharged from main passage 14 into the downdraft will be carried in the reverse direction through secondary passage 15 so as to pass out through inlet 20. In the case of an excessive flue updraft occurring, air from the room being heated may be drawn in through the secondary passage inlet 20 but hot combustion products will still continue to pass through the main passage 14 and so the heat exchanger efficiency will not be greatly affected by the updraft. Thus flue downdraft or excessive updraft will tend to effect flow in the secondary passage 15 rather than in the main passage 14. A blocked flue will cause some combustion products to pass through the main passage 14 and in the reverse direction out of the inlet 20 of the secondary passage 15, while other combustion products will spill directly out of the front of the heater.

In the second embodiment shown in FIG. 4, the heat exchanger 12 includes a passage divider 30 for separating the flow of combustion products through the main and secondary passages 14,15, the passage divider 30 being located within the transfer portion 22 of the secondary passage 15 so as to divide the secondary passage 15 into an upper secondary flow path and a lower outlet portion 31 for the main passage 14. The FIG. 4 embodiment also includes a draft deflector 33 operable to deflect any reverse flow through the main passage 14 under flue downdraft conditions away from the associated burner arrangement 10. The downdraft deflector 33 is operable when all of the combustion products are not discharged from the secondary passage 15 under flue downdraft conditions and some flue downdraft air makes its way into the main passage 14. The deflector 33 prevents the downdraft from directly striking the burner 10 and prevents combustion problems. The downdraft deflector 33 is in the form of a deflector flange projecting forwardly from the inside of the main passage inlet 16.

In the third embodiment of FIGS. 5 to 9, the rear chamber portion 28 comprises a plurality of chambers 35 arranged to receive combustion products from the front chamber 26 and the transfer duct 27, the rear chambers 35 being spaced apart so that the air can pass between the chambers 35, the outside surfaces of the chambers 35 providing a large effective heat exchange surface area. The heat exchanger 12 also includes a passage divider 30 defining a secondary flow path above the divider 30. The plurality of rear chambers 35 of the main passage 14 are operable to discharge combustion products into the outlet portion 36 below the divider 30, the flow of combustion products through the outlet portion 36 joining with the flow of combustion products from the secondary flow path above the divider 30 in the region of the outlet 17.

The embodiment shown in FIGS. 5 to 9 operates on the same principle as the embodiments of FIGS. 1 to 4 but provides a greater surface area for heat exchange between the hot combustion products flowing through the main passage 14 and the air being blown or drawn over the outer surfaces of the heat exchanger 12. In this arrangement there is provided a collection hood 37 for combustion products which hood 37 provides the inlet openings 16,20 for both the main and secondary passages 14,15. The inlet 20 for the secondary passage 15 is relatively high so as to provide a large viewing aperture for a radiant burner 10. The main passage 14 includes a front chamber 26 at the top of the collection hood 37 and transfer duct 27 which conveys the combustion products flowing through the main passage 14 to the plurality of rear chambers 35. Each rear chamber 35 has a relatively large surface area and as shown in FIG. 6 combustion products flow from the transfer duct 27 outwardly and around both sides of the bypass duct 22 of the secondary passage 15. The combustion products merge with the flow through the bypass duct 22 at the outlet 17. Although five rear chambers 35 are shown, more or less chambers 35 may be provided according to requirements.

The outer surfaces of the chamber 35 provide the heat exchanger surfaces over which the air to be heated flows as shown in FIG. 7. The configuration of the collection hood 37 showing the flow paths for combustion products in the main passage 14 can be seen in FIG. 8 and the flow paths for any excess combustion products or inducted air passing through the secondary passage 15 can be seen in FIG. 9.

The FIG. 5 embodiment also includes a constricting means in the form of flange 34 which constricts the outlet mouth of the outlet portion 36 where combustion products passing through the main passage 14 enter the outlet 17. The constricting flange 34 performs two functions—firstly creating a suction or venturi effect in the zone of outlet 17 so that combustion products are drawn through the outlet mouth of the outlet portion 36 when there is a gas flow in the secondary passage 15 past that mouth. Secondly the constricting flange 34 directs air flow under flue downdraft conditions into secondary passage 15 or at least prevents substantial back flow in the main passage 14 and this removes the need to provide the downdraft deflector 33 shown in FIG. 4.

In the FIG. 10 embodiment there is provided condensate collecting means 40 arranged to collect and drain any water condensing within the main passage 14. The condensate collection means 40 includes a collecting channel 41 arranged to pass the condensate to an evaporator 42 of porous heat resisting material located adjacent the burner arrangement 10 where the condensate will be evaporated by the heat from the burner arrangement 10. The condensate collecting means 40 is provided since the efficiency of the heat exchanger 12 can be very high and therefore it is possible for steam in the combustion products to condense and possibly even fill the main passage heat exchange chambers 35 with water.

In the FIG. 10 embodiment the collection hood 12, as in FIG. 5, includes the inlet openings 16,20 for the main and secondary passages 14,15. However the baffle 45 dividing the main and secondary passages 14,15 near their respective inlets 16,20 is hollow to provide an additional surface for transfer of heat from the combustion products to the air being blown or drawn through the heat exchanger 12. To minimise combustion product spillage from the main passage inlet 16 to the secondary passage inlet 20 and to maximise heat exchanger efficiency, the main passage inlet mouth 16 extends low over the burner 10 and even covers part of it. This is done without adversely effecting the radiant performance or appearance of the burners 10 by using a transparent or semi-transparent material for the main passage hood 46. Semi-transparent, ceramic heat resisting materials are available for this application. "Glass Top" cookers make use of a variant of this material. This hood 46 can also serve to cover the exposed portions of the divider baffle 45.

The condensate collected by collecting means 40 from each chamber 35 may be drained say to an external point outside the appliance, such as in a garden, fireplace base, stormwater drain, or gutter. However, as shown in FIG. 10, condensed water can be collected from the base of each chamber 35 and transferred to the air cooled divider baffle 45. Here the condensate is evaporated into the air and discharged into the heated space. This is a very hot part of the heat exchanger 12. To prevent sizzling sounds, evaporator 42 comprising a piece of porous heat resisting material is provided beneath the condensate discharge point in the divider baffle 45. By discharging the evaporated condensate into the heated space the humidity ratio can be increased to a more comfortable level. Also the added cost of installing a condensate drain therefore can be avoided. The remainder of the heat exchanger 12 of FIG. 10 is substantially the same as shown in FIGS. 5 to 9.

In summary, it will be seen that the new heat exchanger has two passages 14,15 through which flue gases can pass, one 15 ("secondary") with very little flow resistance furthest from the burner 10 and the other 14 ("main") with a much higher flow resistance directly above the burner 10. The arrangement functions so that the hot gases which rise quickly and require little flue draw assistance will enter the main heat exchanger passage 14 directly above the burner 10 even though this passsage 14 has a reasonably high flow resistance. The main passage 14 which is very little influenced by flue draw will not draw in cold air from the room being heated which would otherwise reduce heat exchanger efficiency.

The secondary passage 15 with lower flow resistance will collect any lower temperature combustion products and prevent them from entering the room being heated, yet as it basically bypasses the main section of the heat exchanger, the efficiency factor will not be substantially reduced by the introduction of any cold room air into the secondary passage 15.

The embodiments of FIGS. 5 to 10 provide larger effective heat exchanger surface areas. This has been achieved by the single second chamber 28 of the main passage 14 in FIGS. 1 to 4 being replaced by a number of smaller chambers 35 and by the inlet ducts in FIG. 10 being separated by a hollow baffle 45.

The combustion products flow in parallel through the main passage chambers 35 rather than in series. This gives the advantage of a low pressure drop through the passage 14. A low pressure drop is important to ensure fast starting, even heat exchanger temperatures and heat transfer rates and to avoid the need for an expensive powered, forced flue. (Most modern high efficiency gas heating appliances have a series type heat exchanger and a forced flue.)

Finally, it is to be understood that various alterations, modifications and/or additions may be made to the construction and arrangement of parts as herein described without departing from the spirit and scope of the present invention as defined in the appended claims.

I claim:

1. A heat exchanger for use in a heating apparatus having a source of heat in the form of a burner arrangement and a flue for discharging combustion products from the heating apparatus, the heat exchanger being arranged to be associated with the heat source so that heat is transferred from the heat source to a working fluid which in use is in heat exchanger relationship with the heat exchanger, said heat exchanger including a main passage having an inlet opening adapted to be located in proximity to the burner arrangement so as to receive substantially all the hot combustion products therefrom and to convey those products through a main portion of the heat exchanger in heat exchanger relationship with the working fluid and thence to the flue of the heating apparatus, a secondary passage having an inlet opening and arranged to receive in normal operation of the heating apparatus substantially all combustion products not received by the main passage and to convey those products to the flue, the secondary passage having an intake portion which extends upwardly from said secondary passage inlet opening and a transfer portion for communicating with the flue, the secondary passage providing a relatively direct flow path for combustion products passing therethrough to the flue, the main passage including an inlet duct which extends upwardly from said main passage inlet opening and which opens into a chamber, the main passage further including a transfer duct extending from said chamber to a further chamber portion, combustion products passing through the main passage being discharged from said further chamber portion, the outside surface areas of the main passage providing at least a major portion of the heat exchanger surfaces over which working fluid is arranged to pass, the main passage providing an indirect path through the heat exchanger to the flue so that the secondary passage has a lower resistance to flow of combustion products therethrough than the main passage.

2. A heat exchanger as claimed in claim 1, wherein the inlet opening of the main passage is adapted to be located substantially directly above the burner arrangement.

3. A heat exchanger as claimed in claim 1, wherein the main passage provides a tortuous path for flow of combustion products and the main passage is arranged to discharge combustion products laterally into the secondary passage.

4. A heat exchanger as claimed in claim 1, wherein the secondary passage intake portion extends generally vertically and the transfer portion extends generally horizontally for communicating with the flue, the main passage inlet duct extending generally vertically and opening into said chamber, said chamber being located above the secondary passage, said main passage transfer duct extending from said chamber generally horizontally to said further chamber portion.

5. A heat exchanger as claimed in claim 4 wherein the rear chamber portion comprises a plurality of spaced chambers each connected to receive combustion products from the front chamber and the transfer duct, the outside surfaces of the chambers providng a large effective heat exchange surface area.

6. A heat exchanger as claimed in claim 5 and further including a passage divider having one side defining a wall of the transfer portion of the secondary passage and a second side defining a wall of an outlet portion for the main passage, the plurality of rear chambers of the main passage being operable to discharge combustion products into the outlet portion and the flow of combustion products through the outlet portion joining with the flow of combustion products from the secondary flow path adjacent the flue.

7. A heat exchanger as claimed in claim 1 and further including a draft deflector operable to deflect any reverse flow through the main passage under flue downdraft conditions away from the associated burner arrangement.

8. A heat exchanger as claimed in claim 1 wherein the main passage is arranged to discharge combustion products passing therethrough through a constriction operable to inhibit reverse flow in the main passage under flue downdraft conditions.

9. A heat exchanger as claimed in claim 1 and further including condensate means arranged to collect and drain any water condensing within the main passage.

10. A heat exchanger as claimed in claim 9 wherein the condensate collecting means includes a collecting channel arranged to pass the condensate to an evaporator of porous heat resisting material located adjacent the burner arrangement.

* * * * *